US009868303B2

(12) United States Patent
Cummins et al.

(10) Patent No.: US 9,868,303 B2
(45) Date of Patent: Jan. 16, 2018

(54) HORTICULTURE TAG PRINTER

(71) Applicant: Primera Technology, Inc., Plymouth, MN (US)

(72) Inventors: Robert P. Cummins, Deephaven, MN (US); Darren W. Haas, Minnetonka, MN (US); Todd A. Britz, Maple Grove, MN (US)

(73) Assignee: PRIMERA TECHNOLOGY, INC., Plymouth, MN (US)

( * ) Notice: Subject to any disclaimer, the term of this patent is extended or adjusted under 35 U.S.C. 154(b) by 0 days.

(21) Appl. No.: 15/206,067

(22) Filed: Jul. 8, 2016

(65) Prior Publication Data

US 2017/0008317 A1 Jan. 12, 2017

Related U.S. Application Data

(60) Provisional application No. 62/190,940, filed on Jul. 10, 2015.

(51) Int. Cl.
*B41J 3/60* (2006.01)
*B41J 11/70* (2006.01)
(Continued)

(52) U.S. Cl.
CPC ..... *B41J 11/70* (2013.01); *B41J 3/4075* (2013.01); *B41J 3/60* (2013.01); *B41J 11/703* (2013.01);
(Continued)

(58) Field of Classification Search
CPC ..... B41J 11/663; B41J 11/70; B41J 3/4075; B41J 13/00; B41J 13/009; B41J 13/0018;
(Continued)

(56) References Cited

U.S. PATENT DOCUMENTS 3,843,440 A * 10/1974 Davies ..... B65C 3/14 156/354
4,936,818 A * 6/1990 Holohan, Jr. ..... B26D 3/085 493/396

(Continued)

FOREIGN PATENT DOCUMENTS

EP 2127892 A1 * 12/2009 ..... B41J 3/42
GB 2490017 A 10/2012
KR 20040045701 A * 6/2004

OTHER PUBLICATIONS

Sato Catalog Horticulture Solutions Catalog 2014.
European Search Report issued in corresponding application serial No. EP16178865, dated Feb. 14, 2017.

*Primary Examiner* — Sharon A Polk
(74) *Attorney, Agent, or Firm* — Westman, Champlin & Koehler, P.A.; Z. Peter Sawicki; Amanda M. Prose

(57) ABSTRACT

A printer and corresponding method of printing a selected plurality of horticultural identification tags comprising providing a printing system having a housing comprising a first printer, a second printer, a tag creasing mechanism and a tag separating mechanism where a supply of unprinted tags on a continuous roll and connected along a first side to a subsequent tag are directed to an automatic feed mechanism configured to feed at least a first tag through an inlet in the housing to the first printer and printing a selected image on a first side of the tag. Flipping the tag to expose a reserve, unprinted side and feeding the first tag to a second printer for printing a selected image on a reverse side of the tag and flipping the tag to expose the first printed side and automatically feeding the printed tag to a mechanism configured to crease a selected portion of the tag. Providing the tag to a cutter configured to cut a first side of the tag to separate the tag from a subsequent tag and collecting the printed and cut tags in a stack.

20 Claims, 12 Drawing Sheets

(51) Int. Cl.

| | |
|---|---|
| ***B41J 3/407*** | (2006.01) |
| *B41J 13/00* | (2006.01) |
| *B41J 11/66* | (2006.01) |
| *B41J 29/02* | (2006.01) |

(52) U.S. Cl.
CPC ..... *B41J 13/009* (2013.01); *B41J 11/663* (2013.01); *B41J 13/0045* (2013.01); *B41J 29/026* (2013.01)

(58) Field of Classification Search
CPC .... B41J 13/0027; B41J 13/02; B41J 13/0045; B41J 29/026; B41J 3/60
See application file for complete search history.

(56) References Cited

U.S. PATENT DOCUMENTS 5,452,959 A * 9/1995 Oka ..... B41J 3/60 400/149
5,752,776 A 5/1998 Kunreuther
5,973,711 A * 10/1999 Schartner ..... B41J 3/60 347/173
6,296,247 B1 10/2001 Tamura et al.
6,494,449 B2 * 12/2002 Tamura ..... B65H 29/22 270/58.13
8,194,108 B1 6/2012 Long et al.
8,205,789 B2 6/2012 Mori
2003/0079383 A1 * 5/2003 Blackman ..... B41J 15/042 40/299.01
2010/0060706 A1 * 3/2010 Saga ..... B41J 2/32 347/218
2014/0031190 A1 * 1/2014 Collins ..... B31F 1/08 493/405
2014/0139572 A1 * 5/2014 Polk ..... B41J 13/12 347/4
2014/0267477 A1 9/2014 Raming
2015/0091969 A1 4/2015 Biglari

* cited by examiner

HORTICULTURE TAG PRINTER

CROSS-REFERENCE TO RELATED APPLICATIONS

This application claims priority to and the benefit of U.S. provisional patent application Ser. No. 62/190,940, filed on Jul. 10, 2015, the contents of which are hereby incorporated in their entirety.

BACKGROUND

Stake tags for potted plants and other horticultural products contain identifying information for the specific plant as well as care instructions or water/sun indications. Plant tags are generally printed by what is called offset lithography or screen printing. High volume printers run either a sheet or a roll of substrate through a printing press. A plurality of tags are printed on the sheet or roll of material in one pass and the tags are then separated from the printed sheet or roll by a die press or stamp. The amount of tags printed on the sheet or the roll depends on the size of the tag. These printing presses print many multiples of the exact same tag on a given print run. In order to print a different tag, a time consuming changeover of inks, printing plates, dies, and/or media must occur. These presses are large, expensive, and require a skilled operator to run. The disclosed printer uses the same inks for all tags, all of the printing is digital so no printing plates are required. No specialized training is required. Anyone who can operate a desktop inkjet or laser printer can operate it.

Currently, low volume needs must be fulfilled by using thin, specialized substrates with standard desktop printers (laser or inkjet) or by printing simple monochrome tags on barcode printers. Neither of these options can provide a creased tag, so the resulting tag does not have the ideal rigidity for easy insertion into the soil or potting medium. Alternatively, large quantities of creased, offset lithography tags must be purchased and stocked for every variety of plant that a grower or nursery produces.

SUMMARY

An aspect of the present disclosure relates to a printing system for printing individual stake tags for horticultural uses. Individual tags can be printed individually and one by one on both sides of the tag and the stake portion of the tag can be further provided with a crease for ease of insertion into a growing medium, such as soil or dirt. The stake tag printer of the present disclosure allows a user to print individual tags at both low and high volumes. The printer is configured to accept a continuous roll of adjacent stake tags for printing on a first surface. The tags are fed through a first printer for printing on a first side and the tags are then fed to a second printer in a reverse orientation such that a second, opposing side or reverse surface of the tag is then printed with a second printer. The printed tags are then fed to a creasing station for providing a crease to a selected length of the tag. The tags are then separated from the roll and trimmed along the printed sides. Individual tags are then released from the printer and may be stacked for ease of use. The system may also batch multiple different jobs in one print run, i.e. it can print five tags of a first plant type, three tags of a second plant type, and twenty-one of a third plant type in a continuous run.

The printing system is further configured with a controller which controls operation of the first and second printers, the creasing station and the cutting and trimming components. The controller also provides printing instructions to the printers such that a selected design and information can be printed on one tag or thousands of tags depending on the operator's needs. The system is compact to the extent that it can be set on a table or counter top and used in small operating areas for small-scale printing needs.

Another aspect of the present disclosure relates to a method of printing a series of tags for identifying plants. The method comprises loading a roll of tags into a device configured with a first printer, a second printer, a creasing mechanism and a tag cutting and trimming mechanism for separating and finishing each printed tag. The tags are provided in a roll wherein the tags are connected at adjacent sides such that each tag is printed individually, one at a time, by each printer. Thus two tags may be printed simultaneously where one tag is being printed on a first surface by a first printer and a second tag is being printed on a second surface by a second printer. At this same time, a third tag that has already been printed on both sides is being creased and a fourth tag is being separated from the roll. This process can continue until a selected number of tags are printed.

DETAILED DESCRIPTION

The horticultural tag printing system of the present disclosure includes a housing having a first printer, a second printer, a tag stake creasing mechanism and a tag separating and trimming mechanism. The first printer, second printer, tag creasing mechanism and tag separating and cutting mechanism are positioned in series such that a tag is fed from a supply roll to the first printer for printing on a first surface of the tag and the tag may then be fed to the second printer for printing on the opposite or reverse surface of the tag. The printed tag is then fed through a feed mechanism to the creasing station where a crease is imprinted on a stake portion of the tag. The creased and printed tag is then passed through a cutter which separates the tag from adjacent tags in the supply roll and trims the sides of the tags to a selected size. Thus, printing of the first and second sides of the tag occurs sequentially and multiple tags can be printed, creased and/or separated in substantially the same manner continuously if selected.

Figure 1:
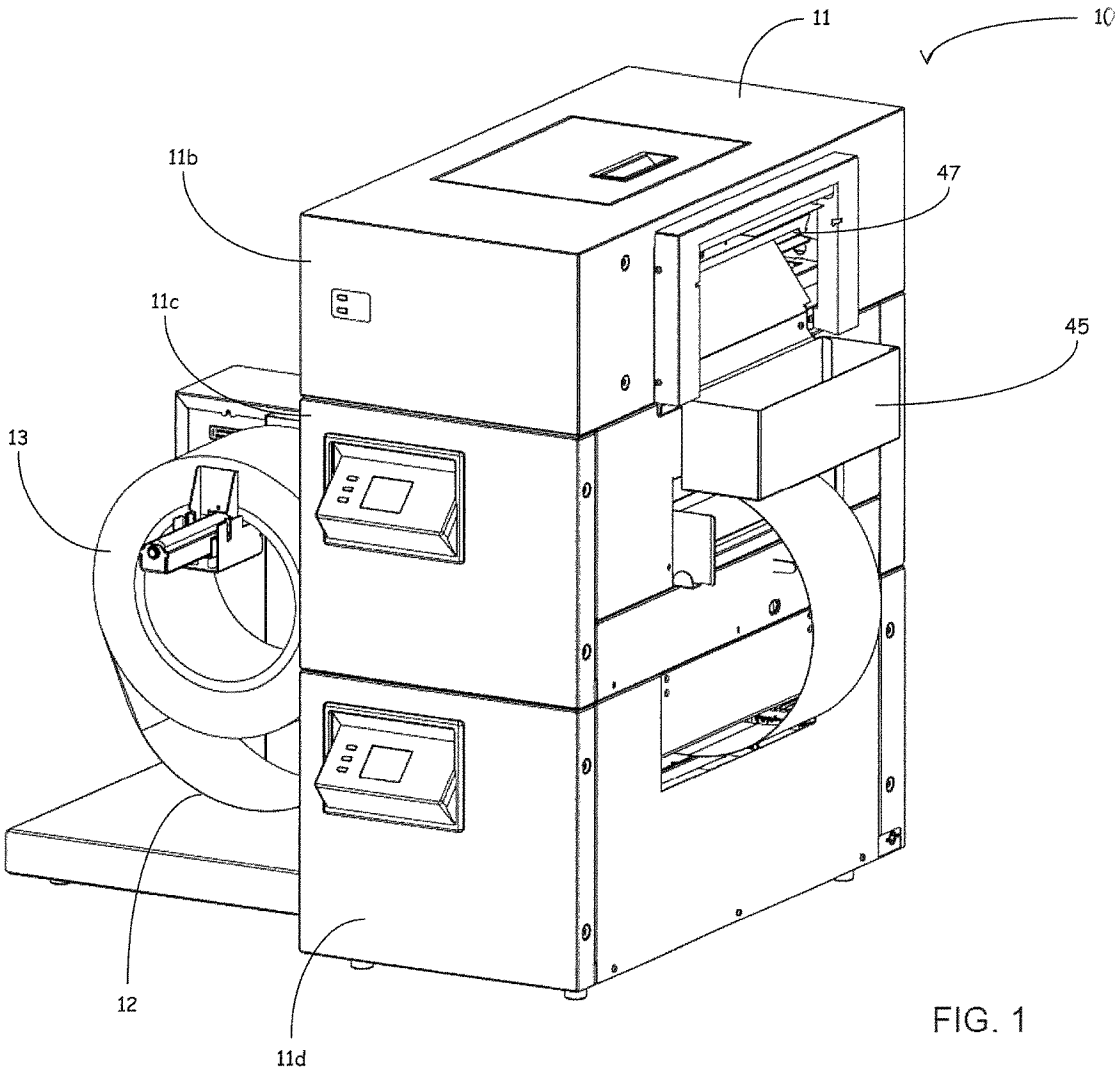
FIG. 1 is a perspective view of a horticultural tag printing system.
Figure 2:
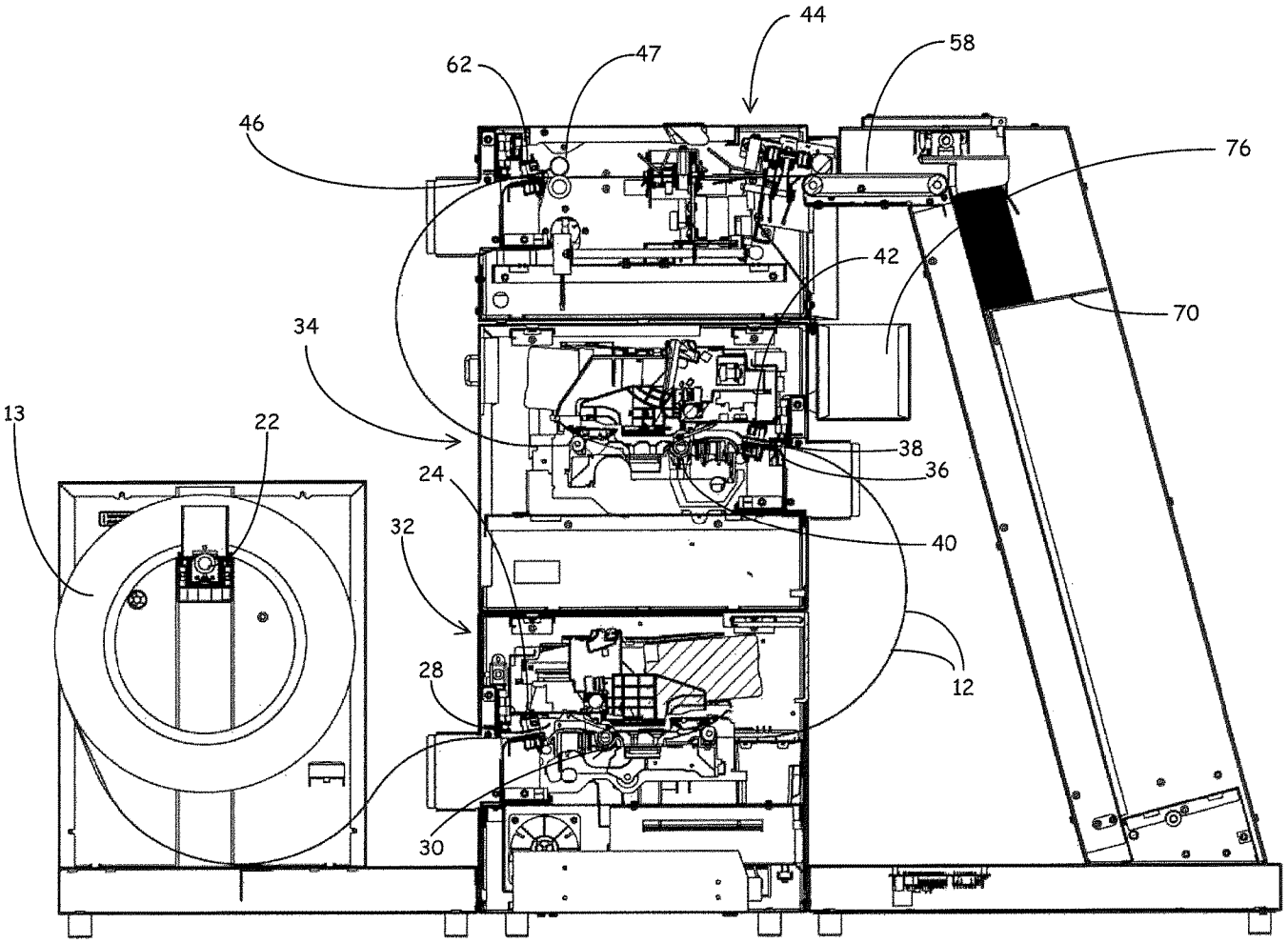
FIG. 2 is a cross-sectional front view of the tag printing system.
Figure 3:
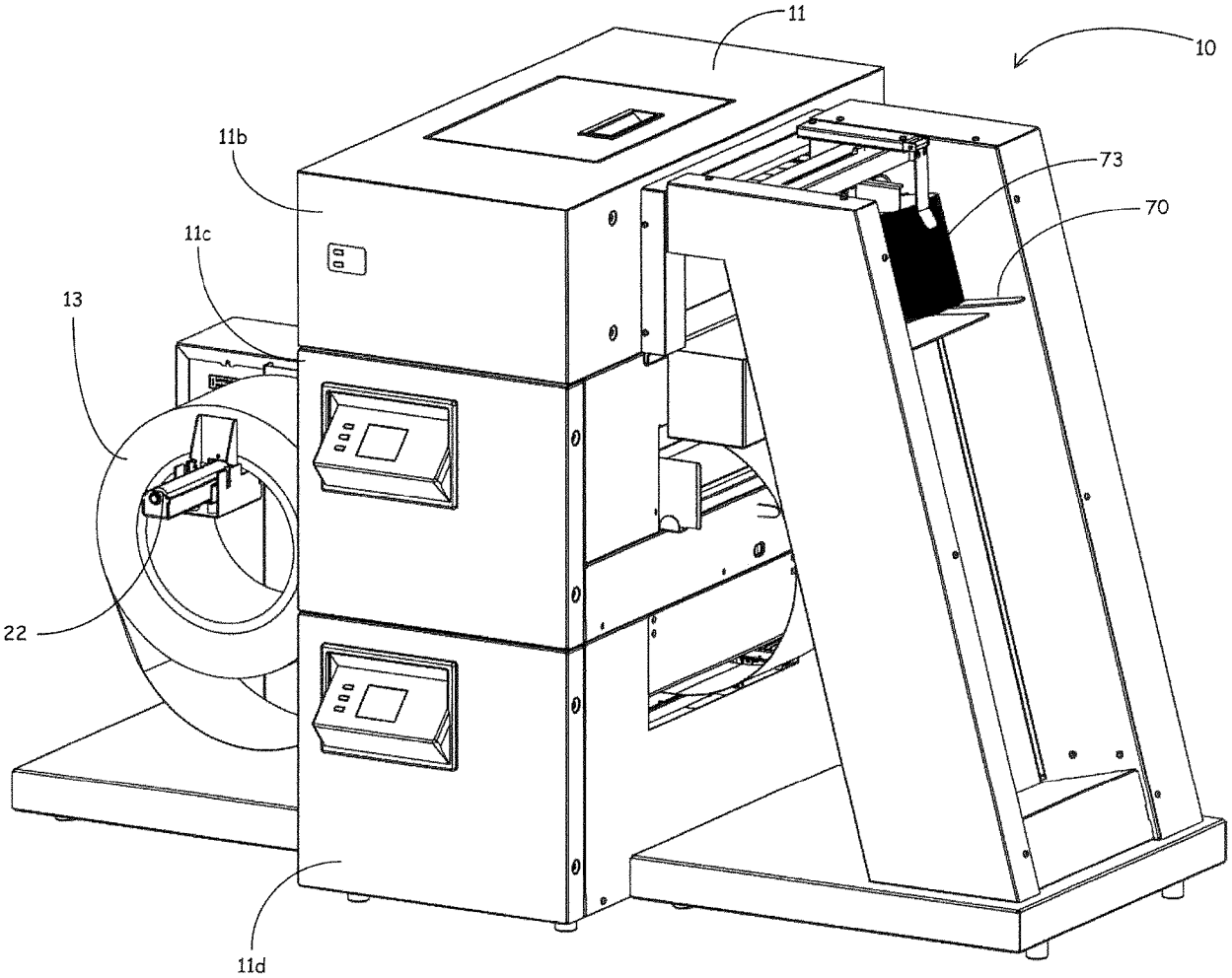
FIG. 3 is a perspective view of the tag printing system having an automatic collecting tray component attached.

The printing system 10 is illustrated generally in FIGS. 1-3. The printing system 10 is configured to receive, print, crease and separate one or more printable tags. Examples of tags include, but are not limited to identification tags such as horticultural identification tags 12. The system 10 comprises a housing 11 in which components of the system 10 are positioned on and/or within. The system is configured to feed tags 12 from a continuous roll, web, or supply of tags 13 into and through the housing 11 for printing, creasing and separating. Each tag 12 comprises a printing portion 14 having a front surface 16 and a back surface 18. The tags have a lower portion, or stake 20 for securing into a pot of a potted plant or into the soil surrounding a plant or flower. The stake portion 20 may or may not be printed with information relating to identification or care of the plant. The stake portion is creased 21 when passed through the creasing mechanism. The stake is creased along a selected length relating to the length of the stake 20 and the crease generally terminates near, along, or prior to the printed portion 14 of the tag. The stake 20 may be generally creased in the center of the tag 12. The system 10 can be adjusted for automatically printing, creasing and cutting tags of various widths and lengths.

Figure 4B:
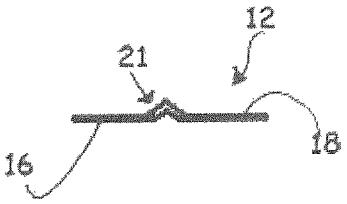
FIG. 4B is an end side view of a creased tag printed with the system.
Figure 4A:
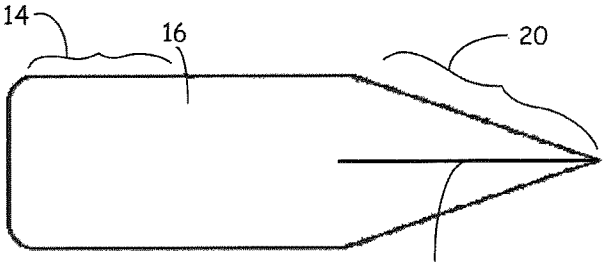
FIG. 4A is a top view of one embodiment of a tag for printing with the system.
Figure 4C:
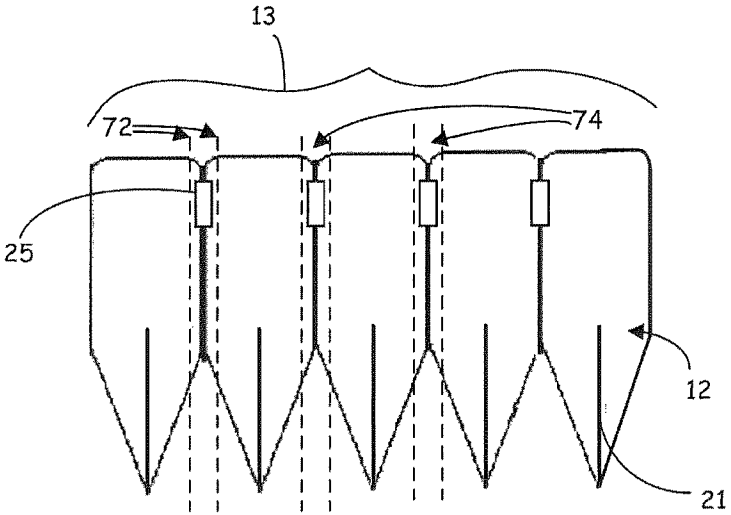
FIG. 4C is a top view of one embodiment of a section of a supply roll or web of tags for printing with the system.

Tags 12 may be provided on a continuous roll, a web or generally supplied in any manner. In the embodiment illustrated, a continuous roll or web 13 of tags are provided. The width of the roll or web may be approximately that of a single tag length as the tags 12 are provided, for example, in roll form by way of being secured alongside edges to adjacent tags, as best illustrated in FIGS. 4A-4C. The tags are separated after printing and creasing by a cutting mechanism which cuts the tags along a length co-extending with the printed portion 14 to provide one or more individual tags. The printed portion of the tag may include some or all of the length of the stake portion 20. The printed portion may cover some or all of each side of the tag, and the size of the printed portion may be selected based on the size of the stake or pot size for which the stake may be inserted. This allows a user to utilize the system to produce a smaller volume of tags without added waste and for a reduced cost.

Figure 5:
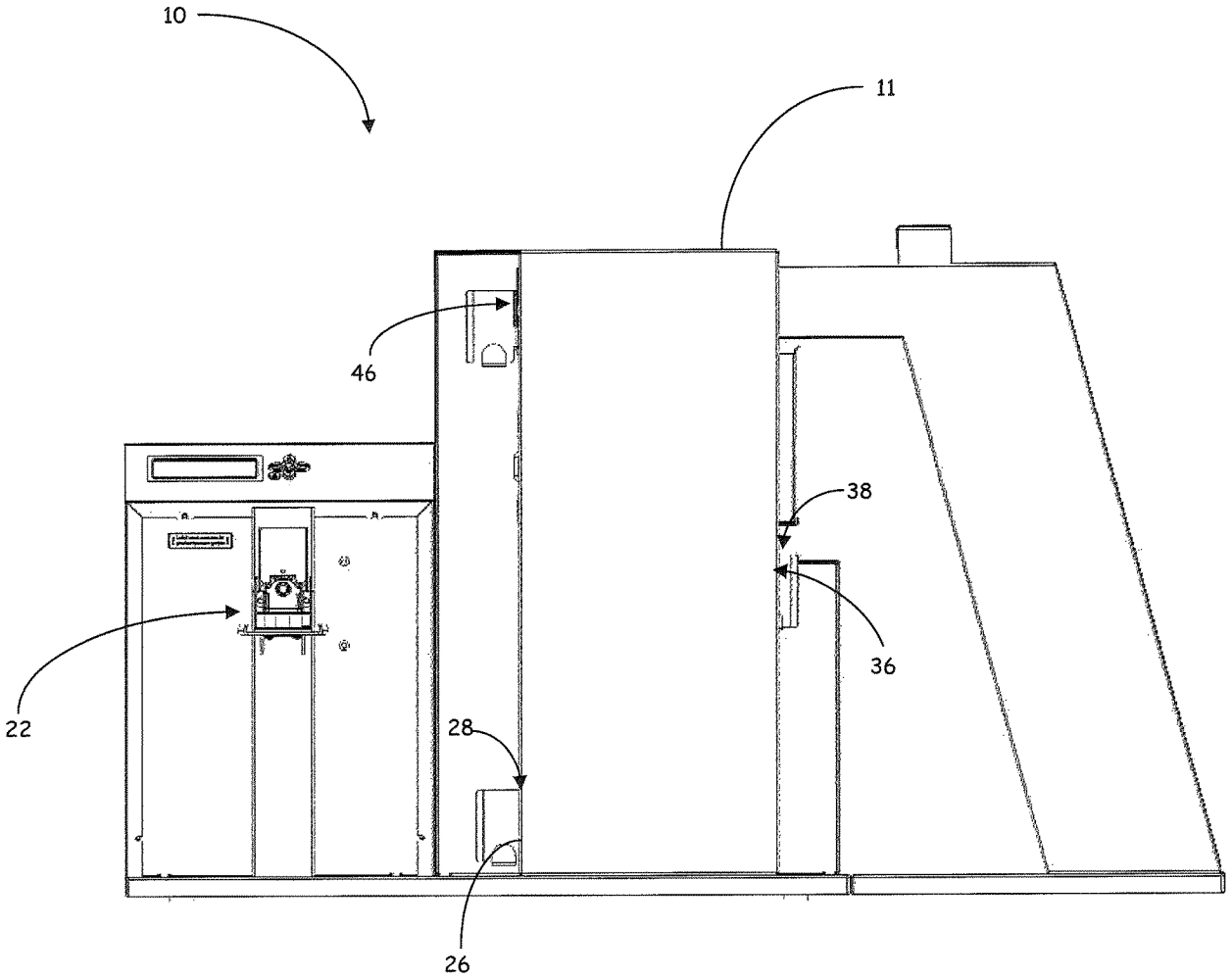
FIG. 5 is an alternative front view of the tag printing system without a supply roll of tags positioned thereon.
Figure 6:
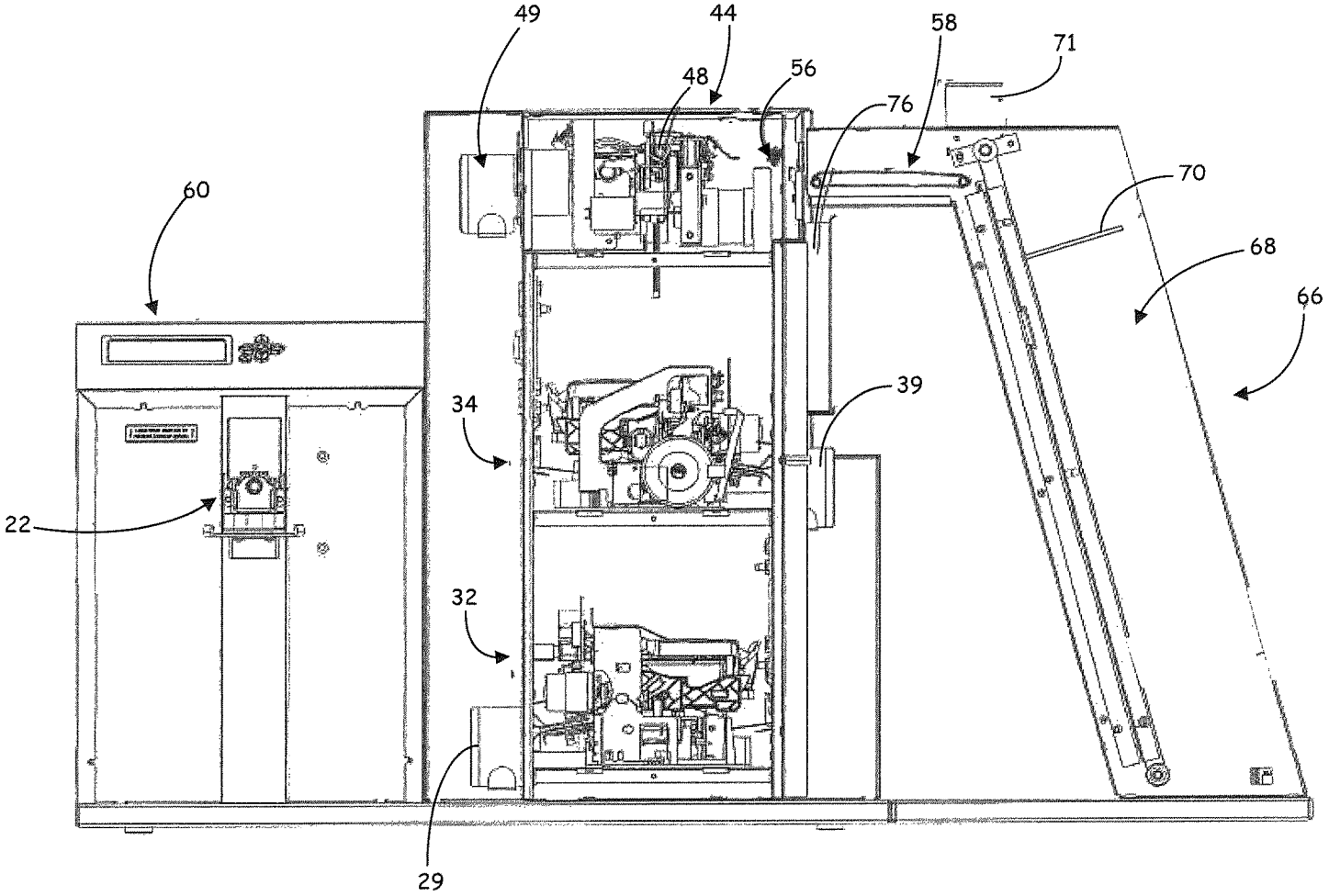
FIG. 6 is an alternative side view of the horticultural tag printing system.

As illustrated in FIGS. 5 and 6, a tag feed roller 22 is configured to support a supply roll or web 13 of unprinted tags 12 for loading into the system 10. The feed roller 22 comprises an outwardly extending shaft for supporting the roll or web 13 of tags 12 and for allowing the tags 12 be fed into and through the system 10. The shaft may be further adapted with arms for securing the roll 13 of tags 12 in a rotatable manner on the shaft. The tag feed roller may be motor driven to advance the roll, tag by tag, into the first printer and to cooperate with the system components to continuously supply tags 12, for example, unprinted and un-creased tags, to and through the system for printing, creasing and finally separation from the roll. For example, a lead tag 12 is fed through an infeed opening 26 in the housing 11 and below a media guide 28 to a feed mechanism 30, the components being configured to feed each tag into the first printer 32 in a controlled manner. The side media guide 29 is slidably adjustable along the length of the tag infeed opening 26 and can be set to the length of the tag 12 for printing. For example, the media guide is moved to set the length of the opening to substantially match the length of the tag up to the terminal end, or point of the stake.

A first sensor assembly 24 is positioned near the opening 26 in the housing 11 and above media guide 28 to determine the position of a tag 12 and to provide a signal to the controller indicating the presence of an unprinted tag for feeding to the first printer 32. The sensor assembly may be, for example, a pass through sensor or a reflective sensor. Where the sensor assembly 24 is a pass-through sensor, a slit 25 is present at the junction of two adjacent tags. An LED light is positioned below the tag path and opening 26 and an optical sensor is positioned above the tag path and opening 26 such that the position of the tags can be detected by the LED light passing through the slit 25. Alternatively, a reflective sensor assembly can be incorporated wherein a black mark is detected. In place of the slit would be a black mark. Each individual tag is sensed and a signal is sent to the controller to indicate to the printer the presence and location of the tag 12.

After a tag 12 has been fed to and passed through the first printer 32 such that a first surface 16 has been printed, the tags are looped around (referring back to FIG. 2) such that the second surface 18 is now positioned as a print surface. The second surface now faces an interface for printing in the second printer 34. The tag 12 is then fed through the second printer 34 and the back side 18 is printed. For example, the tag 12 is fed through a second infeed opening 36 of the second printer 34 and below a second media guide 38 to a second feed mechanism 40, the components being configured to feed each tag into the second printer 34 in a controlled manner that is also synchronized with the feeding of a tag through the first printer 32. The second side media guide 39 is slidably adjustable along the length of the tag infeed opening 36 and can be set to the length of the tag similarly to the first printer infeed system. The second side media guide 39 may similarly be moved to set the length of the infeed opening 36 to substantially match the length of the tag up to the terminal end, or point of the stake portion of the tag. This allows the tags to be printed sequentially and continuously through the first and subsequent printer.

A second sensor assembly 42 may also be positioned near the opening 36 and media guide 38 to determine the position of the tag being fed into the second printer 34 and to provide a signal to the controller indicating the presence of a tag for feeding to the second printer. The sensor 42 assembly may be a sensor assembly configured similarly to the first sensor assembly 24 as described previously.

The first and second printer 32, 34 may be ink jet printers, laser printers or printers of any type such that, for example the printer components are configured for printing in series. In the embodiment illustrated, the first and second printers are ink jet type printers having removable and replaceable ink cartridges and the printing and feed components are provided in and supported in position within the housing 11. In the embodiment illustrated, the first and second printer are positioned such that the second printer 34 is downstream from and positioned above the first printer 32. However, other printer sequences are within the scope of this disclosure.

Once the tag 12 has passed through the second printer, the tag is then passed through another loop which reverses the tag orientation for creasing a front face of the tag. That is, the orientation is reverted back to the orientation of the unprinted tags such that the first printed surface 16 is upwardly or outwardly facing. Each printed tag 12 is fed to an upper assembly 44. While the terms "upper" and "lower" are used here for purposes of distinguishing the segments of the system relative to one another and in no way limit the arrangement of the assemblies. It should be understood that the orientation of the assemblies may take other arrangements and the function as described herein maintained. The upper assembly 44 may also be adapted with an infeed opening 46, media guide 49 and sensor 62 similar to those described with respect to the first and second printers 32, 34. The sensor assembly may be configured to determine the presence of a tag in the infeed opening 46. The sensor assembly is also positioned to re-register the tag 12, similarly to the registration of the tag 12 position with respect to the infeed openings 26 and 36 of the first and second printers 32 and 34. The tag feed mechanism 47 feeds the printed tag to a creasing mechanism 48. The upper assembly 44 further comprises the creasing mechanism 48 configured to provide a crease 21 in the tag 12 (referring back to FIGS. 4A-4C). The creasing mechanism 48, as illustrated in further detail in FIGS. 7-9B, is configured to provide a crease of sufficient depth and length to allow the tag 12 sufficient rigidity for insertion into the soil or growing medium and sufficient to support the tag in an upright position with the stake inserted into the soil or growing medium and at least a substantial portion of the printed section upright and visible for identification. The crease 21 may also allow a thinner tag (for example, by thickness or a lighter stock material) to be studier or to be substantially as sturdy as a tag from a thicker or heavier material. The system is configured for printing, creasing and cutting tags 12 comprising plastic, card stock, coated or laminated paper type materials or other water-resistance tag mediums or coated mediums able to withstand insertion into and prolonged exposure to moist soil.

Figure 8A:
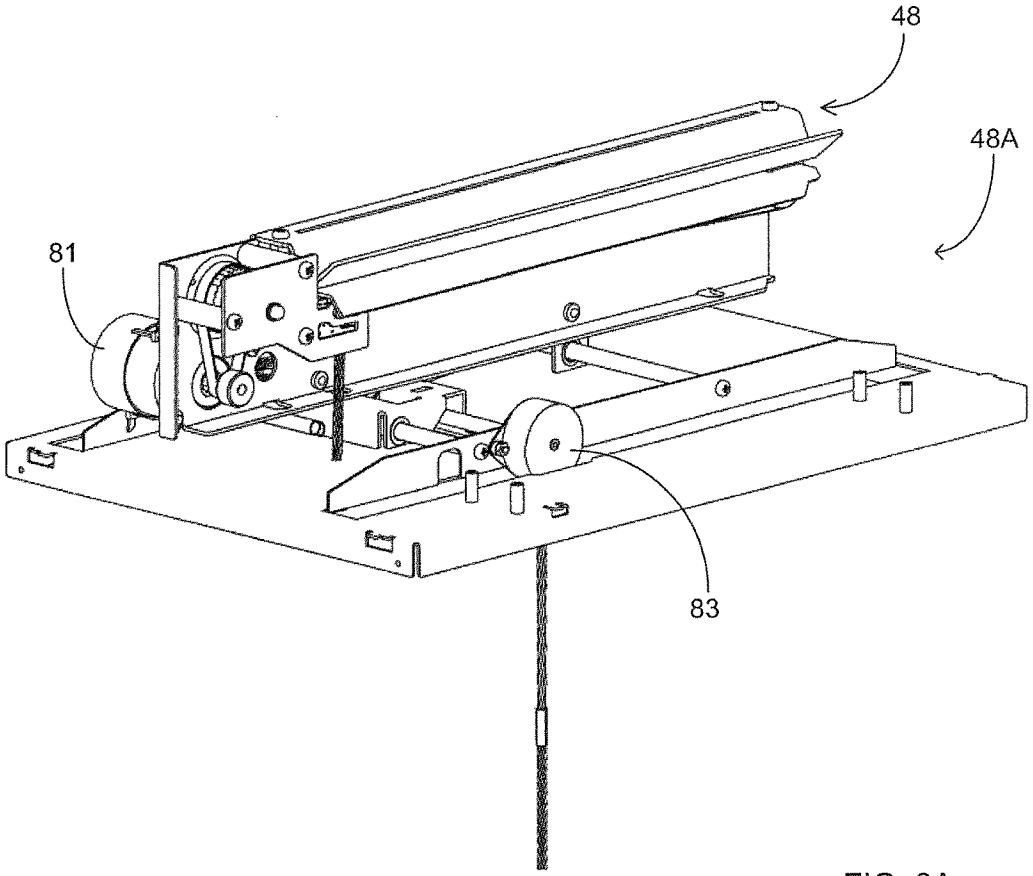
FIG. 8A is a perspective view of a creasing assembly of the system.
Figure 7:
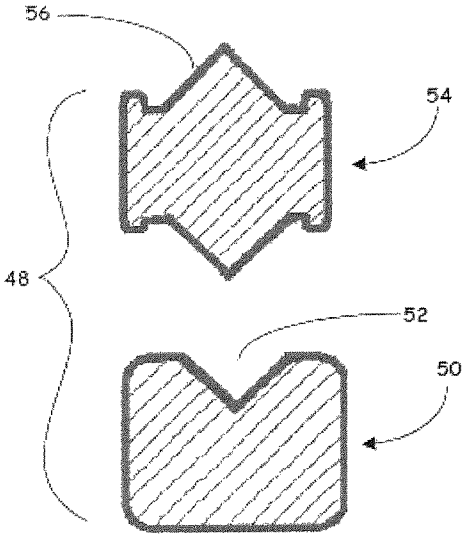
FIG. 7 is a cross-sectional front view of components of a creasing mechanism of the system.
Figure 8B:
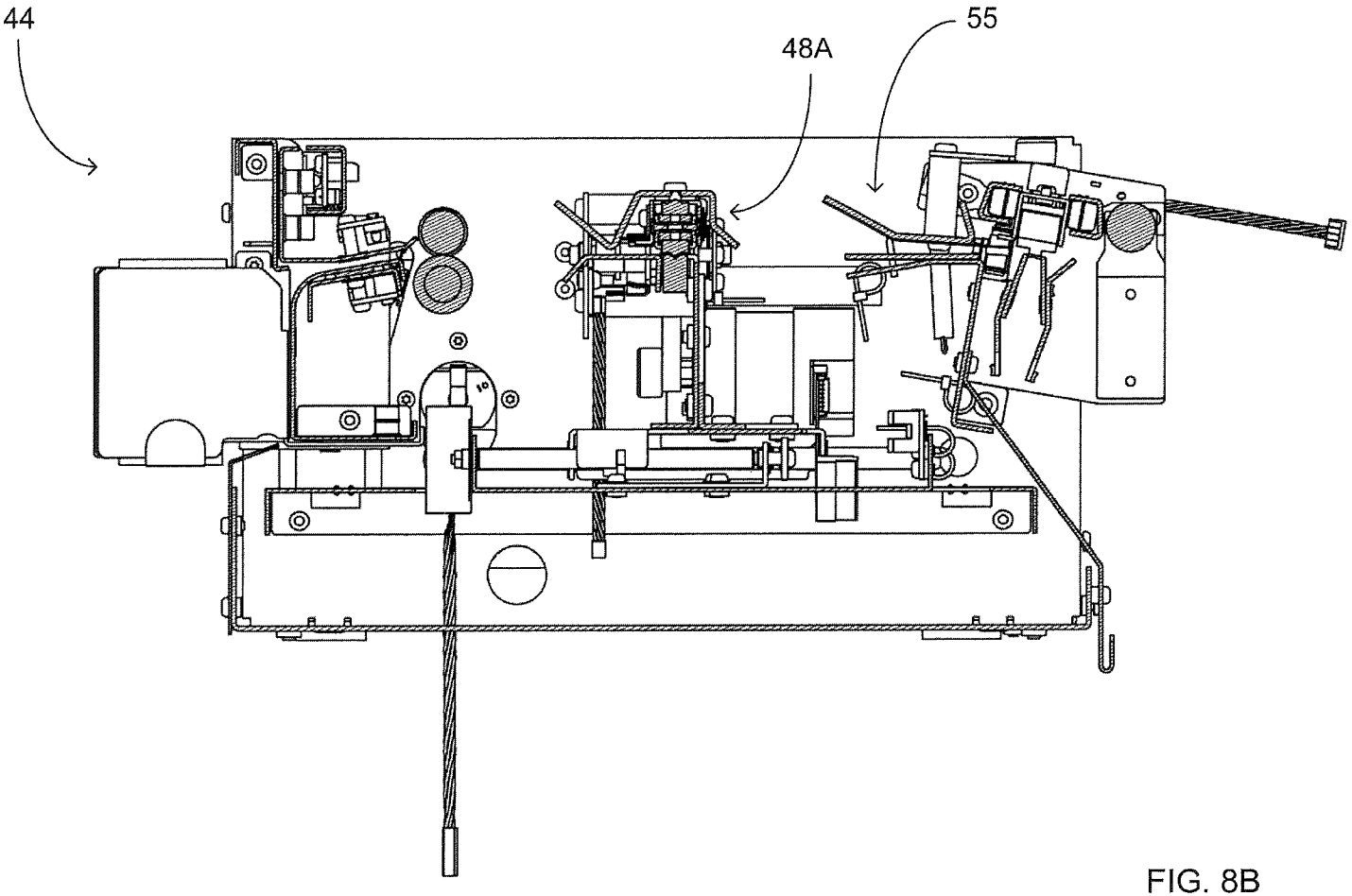
FIG. 8B is a cross-sectional front view of the creasing assembly of the system.
Figure 9B:
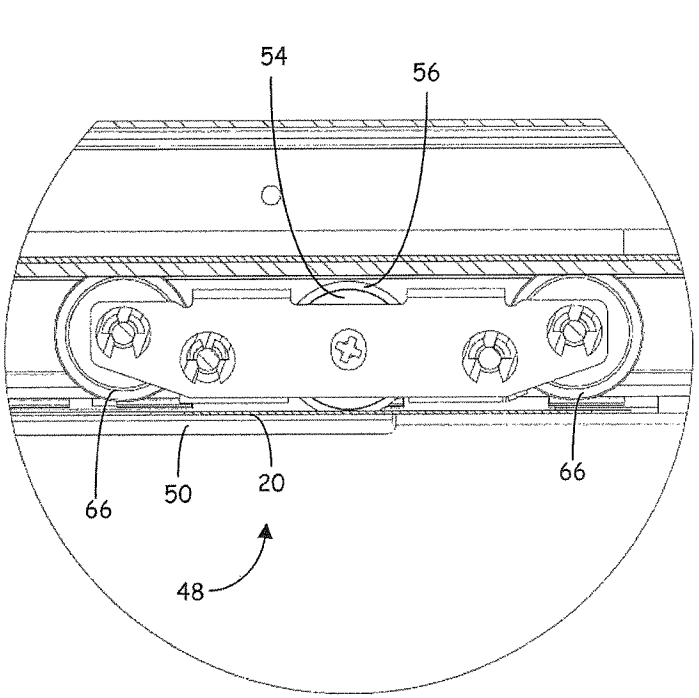
FIG. 9B is cross-sectional side view of the creasing mechanism of the creasing assembly.
Figure 9A:
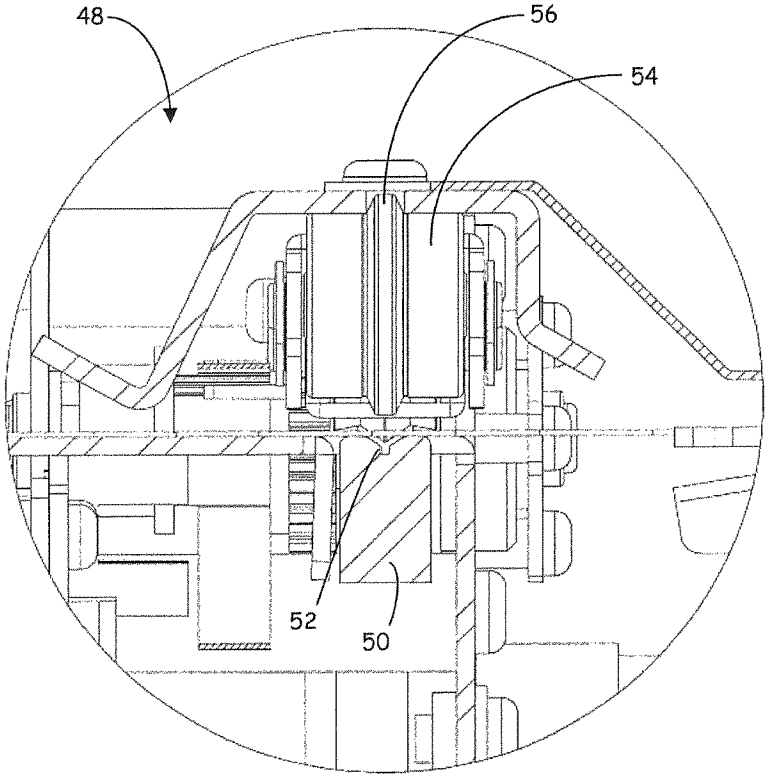
FIG. 9A is a cross-sectional front view of an embodiment of a creasing mechanism of the upper unit of the system.
Figure 10A:
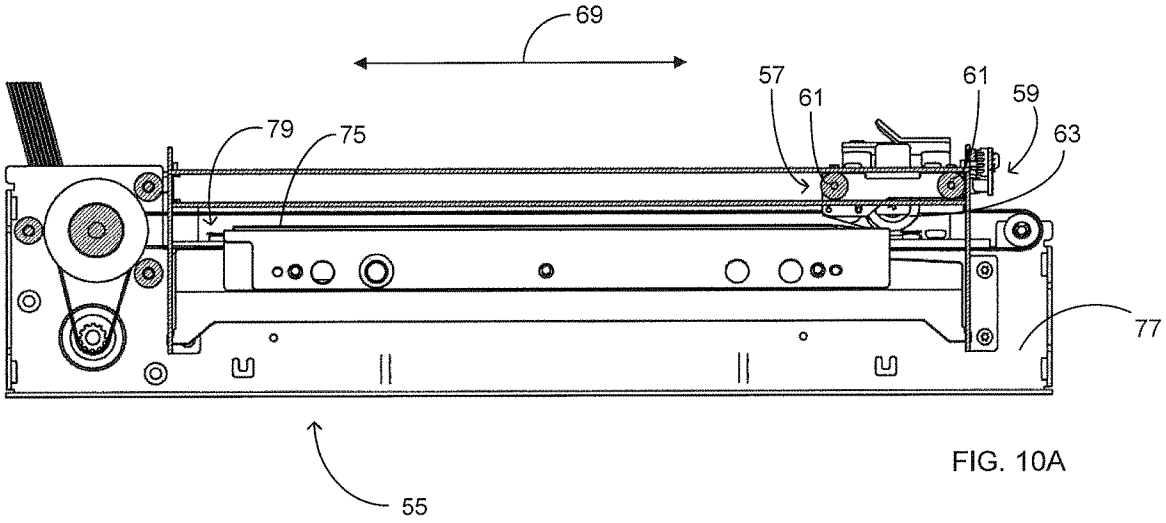
FIG. 10A is a side view of a cutting assembly with a cutter wheel mechanism and the assembly in an unclamped arrangement.
Figure 10B:
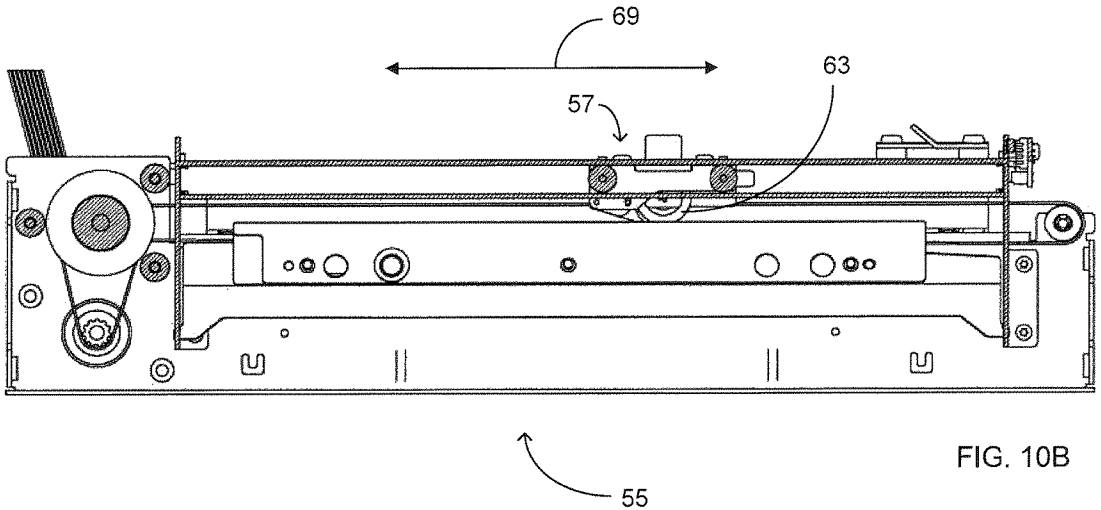
FIG. 10B is a side view of the cutting assembly with the cutter wheel mechanism and the assembly in a clamped arrangement.

The creasing mechanism 48 may be supported by a creasing shuttle 48A illustrated in FIGS. 8A and 8B. The creasing shuttle is positioned such that a tag 12 is fed through a lengthwise slot which holds the tag in position. The creasing mechanism 48 may be positioned under a slot cover which is configured with an upper opening and allows a moveable component of the creasing mechanism 48 to move in reciprocal directions along the length of the slot and channel 52. The movable component may also be configured for cutting and separating tags 12. The creasing mechanism further may further comprise a bar 50 which extends along the width of the housing 11 in a direction transverse to the direction of travel of the tags. Thus, the tag is passed over the bar 50 and under the slot cover such that when the tag 12 is over the bar 50, the tag extends along the bar in a parallel direction. The bar 50 may then be adapted with an indentation extending along its length. The indentation 52 may be, for example, a substantially "v"-shaped channel 52 or groove. As best illustrated in FIGS. 7 and 9, the channel 52 is configured to mate with a roller 54 having a complementary outer surface with an opposing annular projection. The roller is supported for movement between the bar 50 and the slot cover. One or more guide wheels 66 may be positioned and moveably secured to the bar 50 for enabling reciprocal movement of the roller 54 for creasing a stake 20. For example, the roller 54 is adapted with a "v"-shaped protruding outer surface 56 which provides the roller with a geometry that is substantially complimentary to the "v"-shaped groove of the bar 50.

A tag 12 may be positioned over the bar 50 with the stake 20 extending along the length of the bar 50 and centered over the channel 52. The roller 54 is actuated to roll a selected distance along the bar 50 with its outer surface 54 in the channel 52 and pressing the stake 20 into the channel 52 by rolling over the stake 20 and providing downward pressure to crease the stake 20 along the selected length of the channel 52. The roller 54 is configured to move in reciprocal directions along the bar 50 and to various distances determined based on varying lengths of the stake 20. A controller 60 is provided a signal from printing software which indicates the selected displacement of the roller 54 along bar 50 and can be set and/or changed depending on various tag sizes or needs. The roller 54 is further adapted with an aperture centered in its main body which may be configured to accept an axle allowing the roller 54 to rotate freely about the axle while the axle is moved linearly along the selected length of the channel 52.

A feed mechanism is configured to advance the tag 12 downstream of the creasing mechanism 48 to a cutting and trimming mechanism 55. The system can automatically adjust the distance between the creasing mechanism and the cutting mechanism such that creasing and cutting is done concurrently. The cutting and trimming mechanism 55 comprises a cutter wheel assembly 57 and a cutter shuttle or trolley assembly 59 as illustrated in FIGS. 10A-11C. Referring first to the cutting mechanism 55 which includes the trolley assembly 59 illustrated in FIGS. 10A-10B, one or more wheels 61 are positioned for supporting the trolley 59, and in the embodiment illustrated four wheels 61 operably connect the trolley 59 with two channels which allows the trolley to ride on two axles and held in place by fasteners. The trolley 59 holds the cutter wheel assembly 57 in the assembly illustrated in FIGS. 11A-11D and allows for movement of the assembly 57 and for the cutting wheel, in conjunction with the lower cutter blades to cut, separate or trim the tags as illustrated by arrow 69.

Figure 11B:
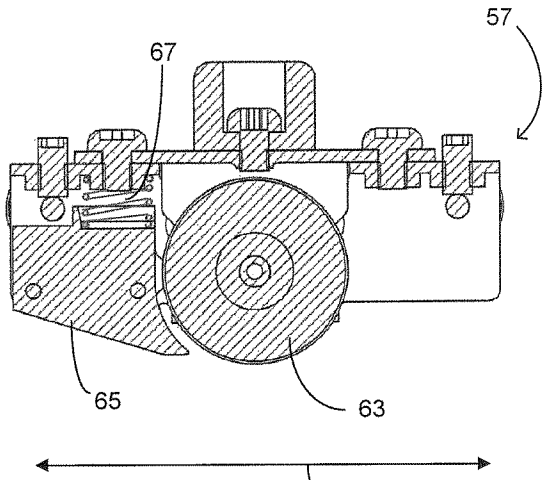
FIG. 11B is cross-sectional side view of the cutter wheel mechanism and spring.
Figure 11A:
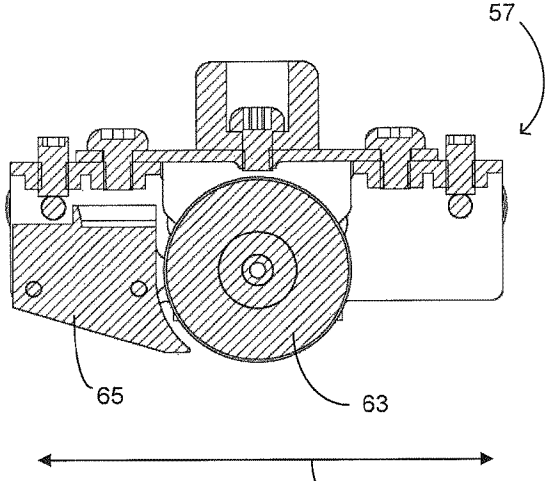
FIG. 11A is cross-sectional side view of a cutter wheel mechanism of the upper unit of the system.
Figure 11C:
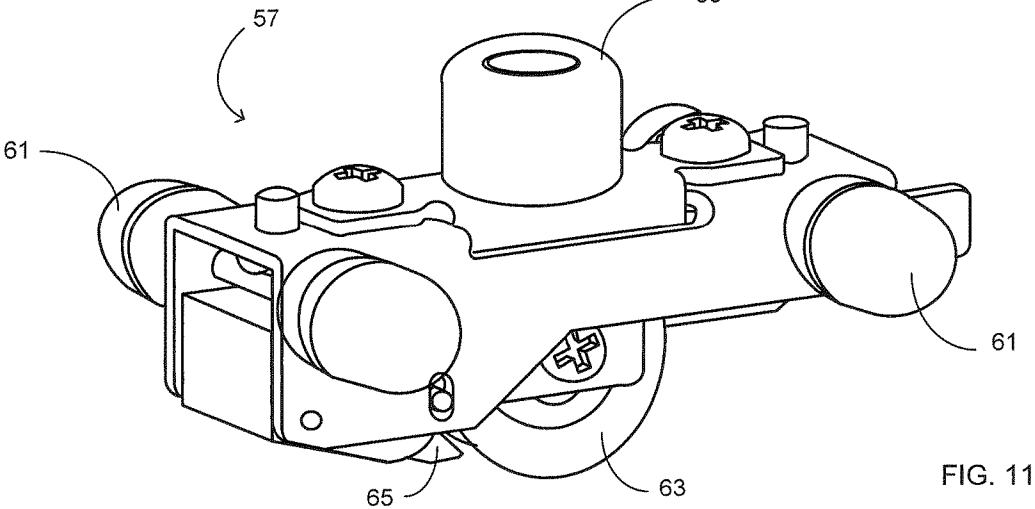
FIG. 11C is a perspective view of the cutter wheel mechanism.
Figure 11D:
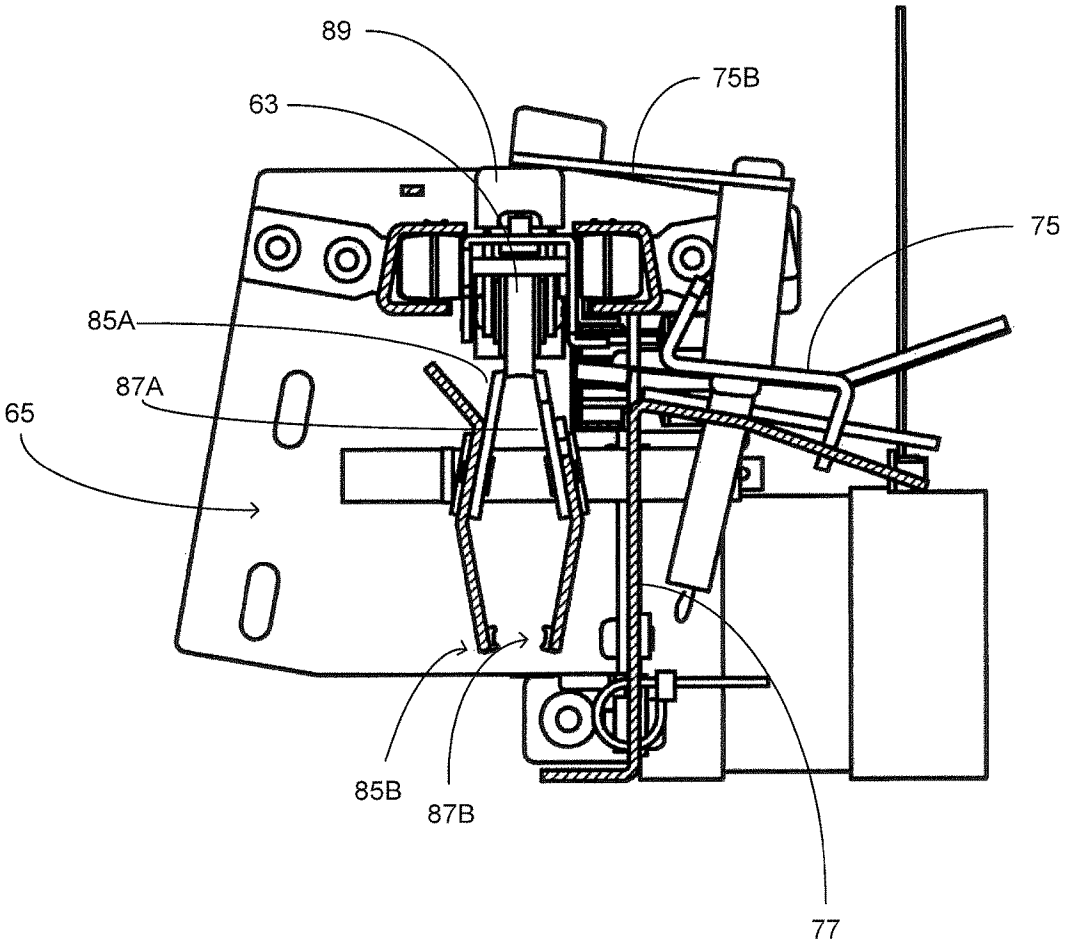
FIG. 11D is a cross-sectional rear view of the cutter wheel mechanism.

The cutter wheel assembly 57 comprises a guide block 65 and cutting wheel 63. The assembly may also further comprise a spring 67 for moving the guide block 65. The spring when compressed pushes on the block 65 and provides a downward force for holding the tag stock flat ahead of the cutting wheel 63. As illustrated in FIG. 11D, two opposing lower cutting blades 85A and 87A are positioned opposing one another and sloping towards one another to a selected tag cutting point. Lower portions 85B and 87B of the cutting blades 85A and 87A are adapted with pivot points on the ends for movement of the cutting blades while a spring, such as a compression spring is provided to urge the lower cutter blades 85B and 87B toward the center cutting wheel 63. The lower cutting blades 85B and 87B are generally positioned on opposing sides of and below or lower than the cutting wheel 63. The tag 12 is thus trimmed and separated along the direction of arrow 69, which the cutting assembly moves reciprocally. Sides of the cutting wheel 63, in conjunction with the corresponding lower cutting blades 85B and 87B work together to cut the tag 12. The assembly cuts as it rolls while the wheel 63 protrudes partially into the space between the opposing lower cutter blades 85B and 87B.

A clamp plate 75 may also be provided on a main frame 77 of the cutting assembly and the clamp plate 75 may be pivotable about protrusions 79 at either end of the cutter 55 and is also operably connected to a clamp lift plate 75B. A pivot pin may operably connect the clamp plate 75 to the main frame 77 in a pivotable manner. The protrusions 79 may then extend from the clamp plate 75 into the main frame 77 by way of the lower tag guide. The clamp plate 75 may also be spring loaded for pivoting. The clamp plate 75 may then be pulled downward by one or more extension springs where lower ends of the spring or springs attach to one or more tabs cut into the cutter main frame 77. Further, a bumper 89, which may be for example, a pad comprised of rubber or a like material, may be secured above the cutter wheel 63. The bumper 89 lifts the clamp plate 75 when the cutter trolley 59 is moved to the far right.

One or more cuts may be made in or to the individual tag 12. For example, a first cut may trim the region of the stake 20 near the sensor slit. The first cut trims off this area from the leading edge of the printed portion of the tag. A second cut, represented by cut-line 72, separates the tag 12 from the continuous roll or web 13 of tags 12 to produce a finished tag 12 such that the tag may have edge to edge printing. The cuts may be made concurrently or sequentially by the cutting wheel and/or the cutting blades. Once the printable tag 12 is printed, trimmed and separated, the tag may be fed to a conveyor 58. Individual tags 12 may be trimmed, cut and removed from the upper assembly 44 by an angled plate 47 attached to the system 10 which allows the tags 12 to drop into a container or box 45 positioned near the system 10. The waste generated by this trimming step may be collected in a receptacle 76 for easy collection and removal of the waste debris 74.

Further, one or more motors 81, 83, for example stepper motors 81, may be positioned in the assemblies and operably connected to the creasing and/or cutter components. As illustrated in the figures, stepper motor 81 is connected to the creasing shuttle. The motors are configured to run the creaser shuttle back and forth in reciprocal directions. The creaser shuttle and the cutter assembly may also be configured to work together for concurrently creasing and cutting tags. For example, the creaser can be moved to allow for movement of the cutter at substantially the same time.

The system 10 is configured for selectively and continuously printing single tags 12 such that the operator can select an amount of tags to be printed with a given image or information at any given time. The system is arranged such that as a first tag is being printed on a first surface in the first printer, a second tag may be printed on a second side in the second printer while a third tag is being creased along its stake and while a fourth tag is being separated and trimmed. Thus a continuous roll of adjacently secured tags can be printed wherein each tag is individually printed as the tags move through the system continuously. Thus, a tag is printed on a first side while a second tag is printed on a second side while a third tag is creased and while a fourth tag is separated and trimmed. The system 10 operates continuously as the tags are provided on a roll for providing tension allowing the continuous roll of tags, comprising individual tags along shared sides of adjacent tags in the roll.

The system is further configured with one or more control boards in communication with a computer or controller for configuring and initiating the printing process. A first control board is configured to control the first printer and a second control board is configured to control the second printer. The control boards are in communication with one another such that if one printer stops the other printer will adjust processing accordingly and vice versa. A control board for the upper assembly is further in communication with the printer control boards such that the speed and processing in the upper unit corresponds with and matches the speed and processing of each tag in the first and second printers. Alternatively, a single control board may be in communication with the printing software and control substantially all of the system 10 components.

It is also contemplated that the tags 12 may be further collected in a stacker 66. The stacker 66 comprises a chute 68 and an elevator plate 70 for receiving the finished tags. The printed and separated finished tags are fed from the trimming mechanism to the stacker 66. The tags may be fed to the stacker for example by a drive mechanism which moves the trimmed individual tag to an upper portion of the chute 68 or by way of a conveyor belt 58 which receives the finished tag 12 and moves the finished tag to the chute 68 for dropping on top of the plate 70. The plate 70 is configured to allow the tags 12 to collect in a pile or a stack 73 accumulating on the elevator plate 70. The stacker 66 is configured to automatically adjust the position of the plate 70 according to the height of the stack of tags accumulating on the plate 70. A position sensor 71 may be incorporated into the chute 68 to detect the position of the plate 70 with respect to the tags accumulating on the plate 70. The sensor 71 is configured to provide a signal to the controller to actuate raising or lowering of the plate in response thereto. Examples of a sensor include but are not limited to a linear position or displacement sensor configured to determine the position of the elevator plate 70 or the position of the upper most tag with respect to the chute 68.

The housing 11, in which the printers 32 and 34 and their respective printing and feed components are positioned within, is further adapted with a plurality of access doors which provide access to the ink cartridges of each printer for replacement as well as provide access to the control boards for each component in the system including the printers, creasing mechanism and/or separating and trimming mechanisms. The control boards and sensor units may be in wired or wireless communication with the controller which may provide instructions to the system 10 for printing, advancing, creasing and/or separating the tags.

Although the present disclosure has been described with reference to preferred embodiments, workers skilled in the art will recognize that changes may be made in form and detail without departing from the spirit and scope of the disclosure.

The invention claimed is:

1. A system for printing horticultural identification tags, the system comprising:

a housing comprising:

a feed roll configured to receive a supply of printable tags;

a first printer station configured to receive a first tag from the feed roll for printing on a first surface on a first side of the first tag;

a second printer station positioned with respect to the first printer and configured to receive the first tag from the first printer for printing on a second surface on a second opposing side of the first tag;

a creasing mechanism configured to receive the first tag from the second printer and configured to form a crease on a selected portion of the first tag; and a cutting mechanism configured to receive the first tag from the creasing mechanism and configured to cut at least one side of the first tag to separate the first tag from an adjacent tag connected to the first tag; and a feed system configured to feed the supply of printable tags through the housing such that the orientation of the printable tag is reversed at least once by the feed system when the printable tags are fed through the housing wherein the first and second printer are configured for sequential printing of first and second sides of the first tag and subsequent tags; and wherein the creasing mechanism and the cutting mechanism are positioned for cutting and creasing the first tag and a subsequent tag concurrently.

2. The system of claim 1, wherein the cutting mechanism further comprises a guide that moves with the cutting apparatus and is configured to retain the tag in a substantially flat manner.

3. The system of claim 1, wherein the cutting mechanism is configured to make two or more cuts simultaneously.

4. The system of claim 1, and further comprising a first sensor positioned near a first printer inlet and configured to sense the presence of an unprinted tag and a second sensor positioned near a second printer inlet and configured to sense the presence of a tag having a first printed surface and a second unprinted surface.

5. The system of claim 4, and further comprising a third sensor positioned proximate the creasing mechanism and configured to determine the presence of a printed tag.

6. The system of claim 4, wherein at least one sensor is a pass-through sensor configured to detect the position of a tag by the detection of light passing through an aperture in a selected position on the tag.

7. The system of claim 1, wherein the creasing mechanism comprises a bar having a channel extending along its length and a corresponding element configured with a surface geometry substantially complimentary to the channel.

8. The system of claim 7, wherein the corresponding element is configured for rolling along the channel to crease a selected length of the tag positioned between the channel and the corresponding element.

9. The system of claim 1, and further comprising a controller in communication with the printer, the controller configured to operate the first and second printers, the creasing mechanism and the cutting mechanism.

10. The system of claim 1 and further comprising a stacking mechanism for stacking printed tags.

11. A method of printing a selected plurality of horticultural identification tags, the method comprising:

providing a printing system having a housing comprising a first printer, a second printer, a tag creasing mechanism and a tag separating mechanism;

providing a supply of unprinted tags on a continuous roll where the unprinted tags are connected along a first side to a subsequent tag in the continuous roll;

providing an automatic feed mechanism configured to feed at least a first tag through an inlet in a housing to the first printer and printing a selected image on a first side of the tag; and flipping the tag to expose a reverse, unprinted side and feeding the first tag to a second printer for printing a selected image on a reverse side of the tag, wherein printing the first side and the second side of the tag is done sequentially.

12. The method of claim 11 and further comprising flipping the tag to expose the first printed side and feeding the printed tag to a mechanism configured to crease a selected portion of the tag.

13. The method of claim 12 and further comprising providing the tag to a cutter configured to cut a first side of the tag to separate the tag from a subsequent tag.

14. The method of claim 13, wherein cutting and the creasing of the tag are concurrent and where the cutting mechanism may be configured to make two cuts concurrently.

15. The method of claim 13, and providing the unprinted tags in a continuous roll such that a length of the continuous roll of tags is fed through the first printer, to the second printer, to the creasing mechanism and to the mechanism for separating the tags once the tag is printed and creased.

16. The method of claim 12, wherein creasing the selected portion of tag comprises positioning the tag over a channel and passing a roller having a complimentary surface geometry over a selected length of the channel to provide a crease in a corresponding length.

17. The method of claim 11, wherein printing the second side of the first tag is substantially concurrent with printing a first side of a second tag.

18. A system for printing horticultural identification tags, the system comprising:

a feed roll configured to receive a supply of printable tags;

a first printer station configured to receive a first tag from the feed roll for printing on a first surface on a first side of the first tag;

a second printer station positioned with respect to the first printer and configured to receive the first tag in a reversed orientation exposing a reverse unprinted side from the first printer for printing on a second surface on the reverse side of the first tag;

a first sensor positioned near a first printer inlet and configured to sense the presence of an unprinted tag and a second sensor positioned near a second printer inlet and configured to sense the presence of a tag having a first printed surface and a second unprinted surface; and wherein the first and second printer are configured for sequential printing of first and second sides of the first tag and subsequent tags.

19. The system of claim 18 and further comprising a creasing mechanism configured to receive the first tag from the second printer and configured to form a crease on a selected portion of the first tag.

20. The system of claim 19 and further comprising a cutting mechanism configured to receive the first tag from the creasing mechanism and configured to cut at least one side of the printed tag to separate the tag from an adjacent tag connected to the first tag.

* * * * *